United States Patent [19]

Chase et al.

[11] Patent Number: 4,720,282

[45] Date of Patent: Jan. 19, 1988

[54] METHOD AND APPARATUS FOR SECURING A CATHODE-RAY TUBE DURING PROCESSING

[75] Inventors: Thomas L. Chase; Kenneth A. Long, both of Lancaster, Pa.

[73] Assignee: RCA Corporation, Princeton, N.J.

[21] Appl. No.: 2,319

[22] Filed: Jan. 12, 1987

Related U.S. Application Data

[62] Division of Ser. No. 889,625, Jul. 18, 1986, Pat. No. 4,695,045.

[51] Int. Cl.[4] ..... H01J 9/20

[52] U.S. Cl. ..... 445/52; 430/23; 324/404

[58] Field of Search ..... 445/3, 5, 6, 52, 68; 430/23–25; 51/283 R; 269/908; 324/404

[56] References Cited

U.S. PATENT DOCUMENTS

| | | | |
|---|---|---|---|
| 2,165,322 | 7/1934 | Weston | 269/228 |
| 2,817,276 | 12/1957 | Epstein et al. | 445/52 X |
| 2,848,295 | 8/1958 | Shellett | 445/52 |
| 3,236,010 | 2/1966 | Evans et al. | 51/283 R |
| 3,381,347 | 5/1968 | Reinwall | 51/283 R |
| 4,507,873 | 4/1985 | Berardi | 33/180 R |
| 4,550,344 | 10/1985 | Buckley | 358/248 |
| 4,656,389 | 4/1987 | Palac | 445/68 X |

*Primary Examiner*—Kenneth J. Ramsey

*Attorney, Agent, or Firm*—E. M. Whitacre; D. H. Irlbeck; T. H. Magee

[57] ABSTRACT

A method for holding a cathode-ray tube in a fixed position during processing utilizes mounting lugs attached to the tube. The apparatus includes a platform having a plurality of legs positioned to support, respectively, the ends of the mounting lugs. Each of the legs has a recess therein aligned with an aperture in the respective lug end. Each lug is secured to the respective leg by a clamp, pivotally attached to each leg, which projects through the aperture into the respective recess when pivoted.

6 Claims, 2 Drawing Figures

METHOD AND APPARATUS FOR SECURING A CATHODE-RAY TUBE DURING PROCESSING this is a division of application Ser. No. 889,625, filed July 28, 1986, now U.S. Pat. No. 4,695,045.

BACKGROUND OF THE INVENTION

This invention pertains to a method for holding a cathode-ray tube in a fixed position during processing, such as a faceplate mechanical grind operation.

In manufacturing a cathode-ray tube, an antiglare surface is put on the faceplate of the tube by a dry mechanical grind operation in order to reduce the gloss on the faceplate surface. It is important that the tube be held in a fixed plane during this operation so that a uniform surface finish is put on the faceplate. Presently, a fiberglass mold is fitted to the funnel of the cathode-ray tube, and this "saddle" fixture supports the tube during the mechanical grind operation.

During this processing, the cathode-ray tube has a tendency to shift and jump out of the saddle fixture, which presents a safety hazard in the factory. Whenever the tube shifts, the saddle fixture removes a conductive coating from scuffed areas where the external surface of the funnel contacts the saddle fixture. This requires the completed tube to be repainted with conductive paint. Also, since the saddle fixture does not secure the tube in a fixed plane, there is a tendency not to get a completely uniform surface finish on the faceplate. The present apparatus and method overcome the above disadvantages by holding the cathode-ray tube in a fixed position during such processing.

SUMMARY OF THE INVENTION

The present invention comprises a method for holding a cathode-ray tube in a fixed position during processing by utilizing mounting lugs attached to the tube. The apparatus includes a platform having a plurality of legs positioned to support, respectively, the ends of the mounting lugs. Each of the legs has a recess therein aligned with an aperture in the respective lug end. Each lug is secured to the respective leg by a clamp, pivotally attached to each leg, which projects through the aperture into the respective recess when pivoted.

DETAILED DESCRIPTION OF THE PREFERRED EMBODIMENTS

Figure 1:
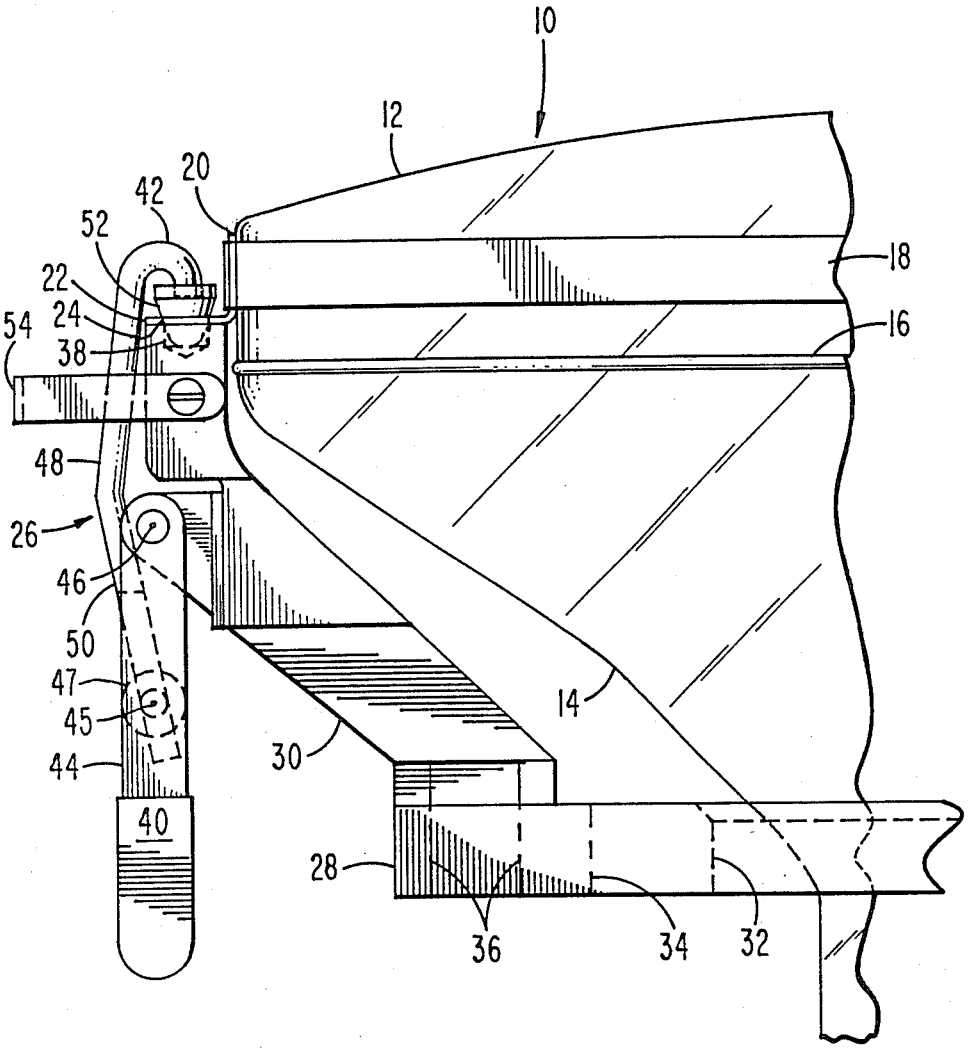
FIG. 1 is a partial elevation view illustrating the apparatus of the present invention holding a cathode-ray tube.

FIG. 1 shows a cathode-ray tube 10 having a faceplate panel 12 sealed to a funnel 14 thereof along an edge 16 of the panel 12. The faceplate panel 12 is substantially rectangular in shape and is encircled by a tensioned implosion protection band 18. The band 18 typically is metal and exerts a compressive force on the sidewall of the panel 12. Substantially L-shaped mounting lugs 20 are disposed between the metal band 18 and the sidewall of the panel 12 at the four corner locations. Each of the lugs 20 has an end 22 which projects way from the tube 10 and contains an aperture 24 subsequently used for mounting the tube 10 in a video monitor and/or television receiver. The lugs 20 are usually attached after the mount sealing and exhausting of the tube 10 are completed.

In the present invention, the cathode-ray tube 10 is held in a fixed position during processing utilizing the mounting lugs 20. It has been discovered that the tube 10 can be securely held by the lugs 20 in a support fixture during the mechanical grind operation without having the lug position distorted by the polish and grind machine. Such a fixture eliminates the need to respray the conductive coating on the external surface of the tube funnel 14.

Figure 2:
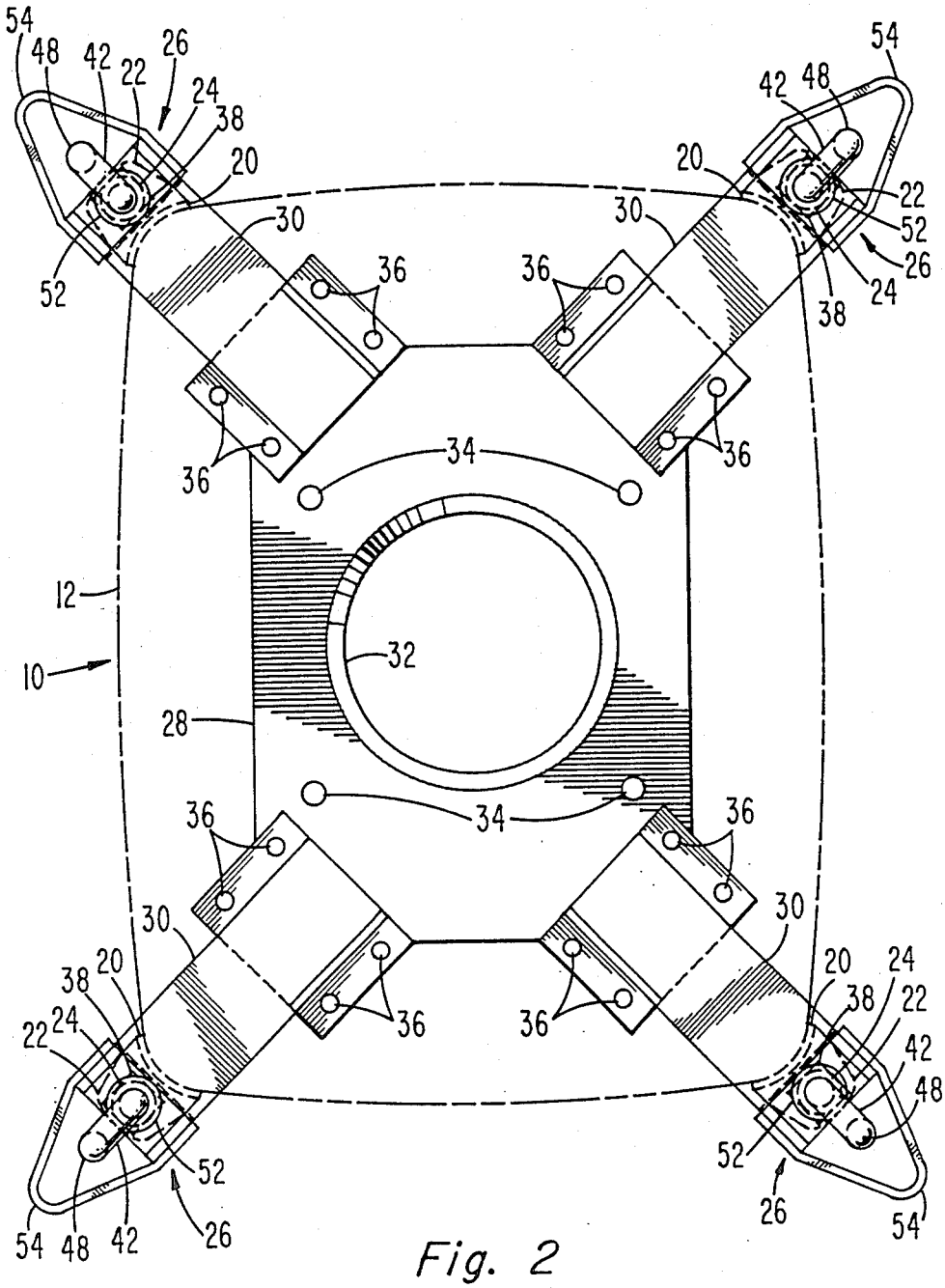
FIG. 2 is a plan view illustrating the present apparatus.

FIGS. 1 and 2 show a tube-support apparatus 26 comprising a horizontal platform 28 having four upwardly extending legs 30 positioned to support, respectively, the ends 22 of the mounting lugs 20. The platform 28 has a circular opening 32 in the center to permit the neck portion of the funnel 14 to extend therethrough, as shown in FIG. 1, and bolt openings 34 for further attachment to supporting equipment (not shown). Each leg 30 is connected, respectively, to a corner of the platform 28 by bolts 36, and has a recess 38 therein aligned with the aperture 24 in the respective lug end 22 supported by that leg 30.

Means 40 are pivotally attached to each of the legs 30 for clamping the respective lug 20 to the leg 30 by projecting an end portion 42 of the clamping means 40 through the aperture 24 into the respective recess 38 when pivoted. Each of the clamping means 40 comprises a handle 44 rotatably attached to the respective leg 30 for pivoting about a fixed axis 46. Each clamping means 40 also includes a J-shaped clamp 48 having a substantially straight portion 50 rotatably attached to the handle 44 about a movable axis 45, and a curved end portion 42 positioned to project through the respective aperture 24, as shown in FIG. 1. Each of the straight portions 50 is attached to the respective handle 44 in a manner that allows each straight portion to move laterally along the movable axis 45. This is accomplished by either a resilient spring washer 47, or simply a loose fitting. Preferably, each of the curved portions 42 has a cone-shaped tip 52 disposed at the end thereof for forming a press fit with both the respective aperture 24 and the recess 38. In the present embodiment, the cone-shaped tips 52 are made of nylon.

The apparatus 26 further comprises means attached to each of the legs 30 for keeping the respective J-shaped clamp 48 in an upright position proximate the recess 38 when the clamp 48 is in an unclamped mode. In the present embodiment, each of the keeping means comprises a U-shaped loop 54 attached at both ends to the respective leg 30, as shown in FIGS. 1 and 2. The loops 54 may be made of aluminum.

In operation, the cathode-ray tube 10, with four mounting lugs 20 attached to the corners of the tube 10, is placed on the support apparatus 26 by supporting the ends 22 of the lugs 20, respectively, on the distal end surfaces of the legs 30 so that the recess 38 in each leg 30 is aligned with the aperture 24 in the respective end 22. The cone-shaped tips 52 are positioned, respectively, to project through the apertures 24, and each lug 20 is then clamped to the respective leg 30 by pivoting each handle 44 away from the lug 20 until each of the curved end portions 42 securely holds each lug 20 to the respective leg 30. As each handle 44 rotates about the respective fixed axis 46, the end portions 42 are forced downward through the apertures 24 and into the respective recesses 38. The cone-shaped tips 52 are thereby inserted, respectively, through the apertures 24 and into the recesses 38 to form a press fit with both the respective aperture 24 and recess 38, thereby securely holding the lugs 20 to the respective legs 30. Since each J-shaped clamp 48 is able to move laterally along the movable axis 45, the lugs 20 are able to be clamped to the legs 30 without changing their positions even though such positions are slightly different from tube to tube.

Data measurements were made on several tubes to determine whether the lug position changed during processing with the present support apparatus 26. It was discovered that the tube 10 can be securely held in the support apparatus 26 during the mechanical grind operation without having the lug position distorted or appreciably changed by the polish and grind machine. Since the apparatus 26 secures the tube 10 in a fixed plane, a uniform surface gloss is able to be placed on the faceplate. The present technique also eliminates the need to respray the conductive coating on the tube 10. In addition, since the tube is live (has been partially exhausted of gases) during the mechanical grind process, the apparatus 26 removes a factory safety hazard by preventing the tube from shifting and jumping out of the support fixture.

What is claimed is:

1. A method of holding a cathode-ray tube in a fixed position during processing utilizing mounting lugs attached to said tube, each of said lugs having an end projecting away from said tube and containing an aperture, comprising:

supporting the ends of said mounting lugs, respectively, on legs connected to a platform, each of said legs having a recess therein aligned with the aperture in said respective end, and clamping each lug to said respective leg by pivoting clamping means, attached to each of said legs, until an end portion of each of said clamping means projects through said aperture into the respective recess.

2. A method as recited in claim 1 wherein each of said clamping means comprises a handle rotatably attached to the respective leg for pivoting about a fixed axis, and also a J-shaped clamp having a substantially straight portion rotatably attached to said handle about a movable axis and a curved end portion positioned to project through said respective aperture, and wherein said clamping step is performed by pivoting each of said handles away from said lugs until each of said curved portions securely holds each lug to said respective leg.

3. A method as recited in claim 2 wherein each of said straight portions is attached to said respective handle in a manner that allows each straight portion to move laterally along said movable axis.

4. A method as recited in claim 2 wherein each of said curved portions has a cone-shaped tip disposed at the end thereof, said tip forming a press fit with both the respective aperture and recess.

5. A method as recited in claim 4 wherein each of said cone-shaped tips is made of nylon.

6. A method as recited in claim 1 wherein the ends of said mounting lugs are supported, respectively, on four legs.

* * * * *